US005969635A

United States Patent [19]

Goto

[11] Patent Number: 5,969,635

[45] Date of Patent: Oct. 19, 1999

[54] RADIO PAGING RECEIVER IN WHICH ANNOUNCEMENT OF A CALL IS CONTROLLED IN ACCORDANCE WITH A FORM OF A RECEIVED SIGNAL

[75] Inventor: Kazuhumi Goto, Shizuoka, Japan

[73] Assignee: NEC Corporation, Tokyo, Japan

[21] Appl. No.: 08/816,421

[22] Filed: Mar. 14, 1997

[30] Foreign Application Priority Data

Mar. 27, 1996 [JP] Japan ..... 8-071677

[51] Int. Cl.[6] ..... G08B 5/22

[52] U.S. Cl. ..... 340/825.44; 340/825.37; 340/825.48; 455/38.1; 455/38.2; 455/38.4; 455/38.5

[58] Field of Search ..... 340/825.44, 825.37, 340/825.48; 455/38.1, 38.2, 38.4, 38.5

[56] References Cited

U.S. PATENT DOCUMENTS

| | | | |
|---|---|---|---|
| 4,419,668 | 12/1983 | Ganucheau, Jr. | 340/825.44 |
| 4,922,221 | 5/1990 | Sato et al. | 340/825.44 |
| 5,012,219 | 4/1991 | Henry | 340/311.1 |
| 5,221,923 | 6/1993 | Tsunoda et al. | 340/825.44 |
| 5,764,157 | 6/1998 | Kudoh | 340/825.44 |

FOREIGN PATENT DOCUMENTS

| | | |
|---|---|---|
| 2-15721 | 1/1990 | Japan . |
| 2 267 770 | 12/1993 | United Kingdom . |
| WO 90/09082 | 8/1990 | WIPO . |

*Primary Examiner*—Brian Zimmerman
*Assistant Examiner*—Yves Dalencourt
*Attorney, Agent, or Firm*—Young & Thompson

[57] ABSTRACT

In the radio paging receiver having an announcing arrangement for announcing reception of a radio call signal, an operable switch (16) is provided for determining a particular mode relating to an operation of the announcing arrangement. Received with the radio call signal, a receiving arrangement produces a received signal. In accordance with a state of the operable switch and with a form of the received signal, a control section (17) controls the operation of the announcing arrangement. It is preferable that the control section inhibits the operation of the announcing arrangement when a massage is absent in the radio call signal.

10 Claims, 2 Drawing Sheets

RADIO PAGING RECEIVER IN WHICH ANNOUNCEMENT OF A CALL IS CONTROLLED IN ACCORDANCE WITH A FORM OF A RECEIVED SIGNAL

BACKGROUND OF THE INVENTION

This invention relates to a radio paging receiver for being responsive to a radio call signal.

In a paging system including such a radio paging receiver, use can be made of a radio call signal carrying a call number and a message. A specific number is assigned to each radio paging receiver. When received with the radio call signal, the radio paging receiver carries out a judgement about whether or not the call number is coincident with the assigned specific number. When the call number is coincident with the assigned specific number, the radio paging receiver announces a call to a user of the paging receiver and makes a display unit display the message as a received message.

Recently, various proposals have been made in order to increase a function of such a radio paging receiver. One of the proposals is disclosed in Japanese Unexamined Patent Publication No. 15721/1990. In this proposal, collation-is made between the received message and a specific message preliminarily memorized. With reference to a result of the collation, an announcing mode is changed, for example, to announcement by sound generation or intermittent light emission of an LED. More particularly, the announcing mode is changed in dependence upon whether or not the received message is coincident with the specific message.

It is assumed that the paging receiver receives the radio call signal carrying the call number alone. In this event, the function of the above-mentioned proposal is unavailable. This is because it is impossible to carry out the collation.

SUMMARY OF THE INVENTION

It is an object of this invention to provide a radio paging receiver in which announcement of a call is controlled in accordance with a form of a received signal.

It is another object of this invention to provide a radio paging receiver of the type described, which is capable of selecting, by operation of a use of the radio paging receiver, non-announcement of a message transmitted with a wrong address number.

Other objects of this invention will become clear as the description proceeds.

A radio paging receiver to which this invention is applicable is for being responsive to a radio call signal. The radio paging receiver comprises receiving means for receiving a radio call signal to produce a received signal, announcing means for announcing announcement, an operable switch for determining a particular mode concerning to an operation of the announcing means, and control means connected to the receiving means, the announcing means, and the operable switch for controlling the operation of the announcing means in accordance with a state of the operable switch and with a form of the received signal.

According to this invention, there is provided a method of being responsive to a radio call signal. The method comprises the steps of receiving the radio call signal to produce a received signal, announcing announcement, determining a particular mode relating to the announcement, judging whether or not the particular mode is determined, producing a particular mode signal when the particular mode is determined, judging in response to the particular mode signal whether or not a message is present in the received signal, producing a message absence signal when the message is absent in the received signal, and inhibiting the announcement in response to the message absence signal.

DESCRIPTION OF THE PREFERRED EMBODIMENT

Figure 1:
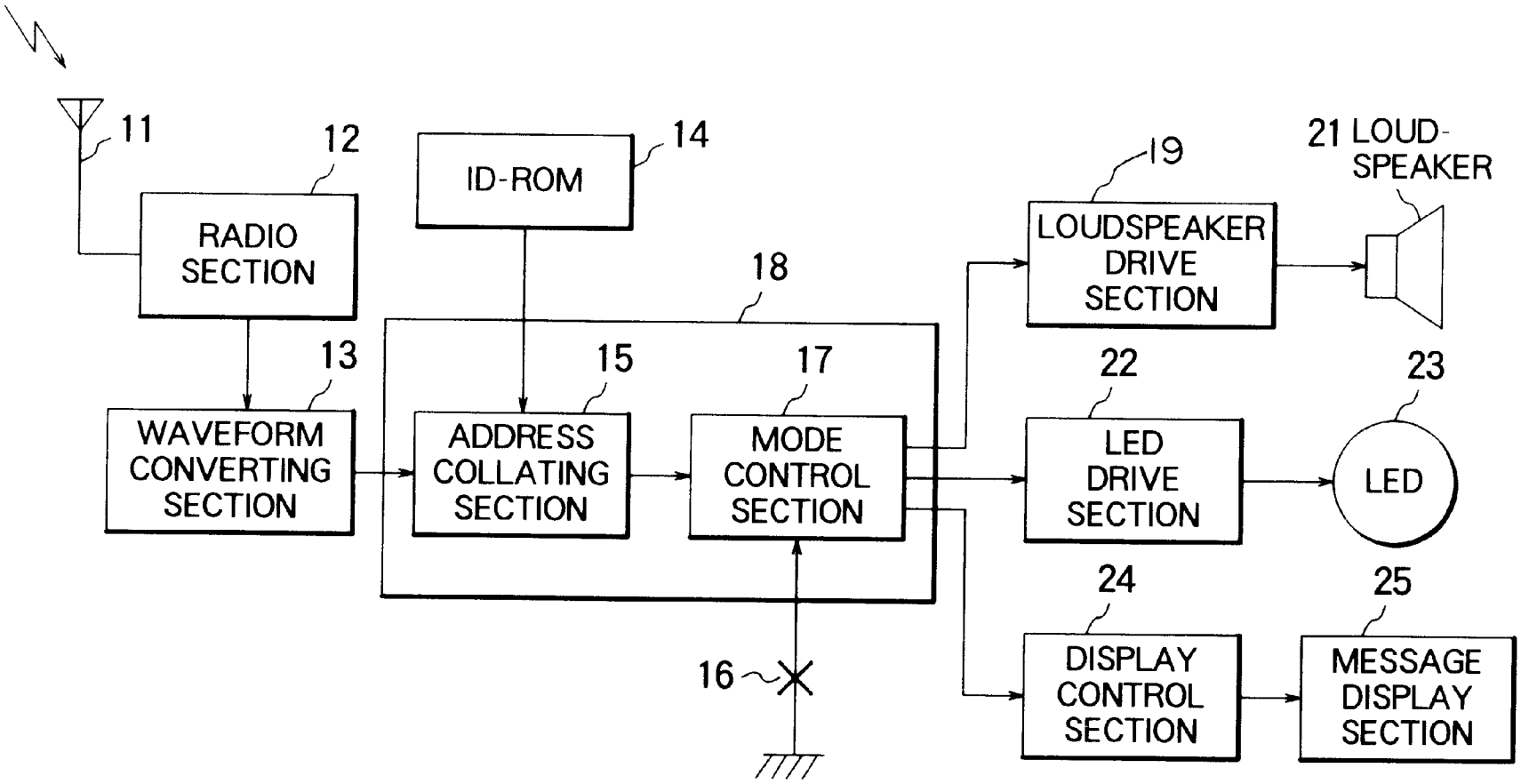
FIG. 1 is a block diagram of the radio paging receiver according to an embodiment of this invention.

Referring to FIG. 1, description will be made as regards a radio paging receiver according to an embodiment of this invention. In the manner which will presently be described, the radio paging receiver comprises an antenna 11, a radio section 12, a waveform converting section 13, an address memory or an ID-ROM 14, an address collating section 15, an operable switch 16, and a mode control section 17.

The radio section 12 is for receiving through an antenna 11 a radio call signal which is transmitted from a calling party. Generally, the radio call signal carries a specific address and a message. In a particular case, the radio call signal carries the specific address only. When received with the radio call signal, the radio section 12 amplifies and demodulates the radio call signal into a demodulated signal. The waveform converting section 13 is connected to the radio section 12 and is for converting the demodulated signal into a waveform-converted signal. The ID-ROM 14 is for preliminarily memorizing an assigned address or an identificaiton number assigned to the radio paging receiver. The address collating section 15 is connected to the waveform converting section 13 and the ID-ROM 14 is responsive to the waveform-converted signal for collating the specific address with the assigned address to make the waveform-converted signal pass therethrough only when the specific address is coincident with the assigned address. A combination of the radio section 12, the waveform converting section 13, ID-ROM 14, and address collating section 15 is referred to as a receiving section which is for receiving the radio call signal to produce the waveform-converted signal as a received signal. In the manner known in the art, the received signal has a form depending upon whether or not the radio call signal carries a message.

The operable switch 16 is operable by a user of the radio paging receiver and is for producing a mode selection signal representative of an any one of on-state and an off-state. When set in the on-state, the operable switch 16 determines a particular mode relating to an operation of an announcing arrangement which will later be described in detail.

The mode control section 17 is connected to the address collating section 15 and the operable switch 16 and is for producing a first, a second, and a third control signal in accordance with the waveform-converted signal and the mode selection signal to carry out a predetermined announcement in the manner which will later be described in detail. A combination of the address collating section 15 and the mode control section 17 is called a decoder section and designated by a reference numeral 18.

The radio paging receiver further comprises a loudspeaker drive section 19, a loudspeaker 21, a light emitting diode (LED) drive section 22, an LED 23, a display control section 24, and a message display section 25. The loudspeaker drive section 19 is connected to the mode control section 17 and the loudspeaker 21 and is for driving the loudspeaker 21 in response to the first control signal to make the loudspeaker 21 generate a sound. The LED drive section 22 is connected to the mode control section 17 and the LED 23 and is for driving the LED 23 in response to the second control signal to make the LED emit intermittent light. The display control section 24 is connected to the mode control section 17 and the message display section 25 to make the message display section 25 display the message thereon.

In the radio paging receiver, a combination of the loudspeaker drive section 19 and the loudspeaker 21 will be called an audible indicating arrangement. A combination of the LED drive section 22 and the LED 23 will be called a visible indicating arrangement. A combination of the audible and the visible indicating arrangements will be named a call indicating arrangement. A combination of the display control section 24 and the message display section 25 will be called a displaying arrangement. A combination of the call indicating and the displaying arrangements is referred to as an announcing arrangement.

Figure 2:
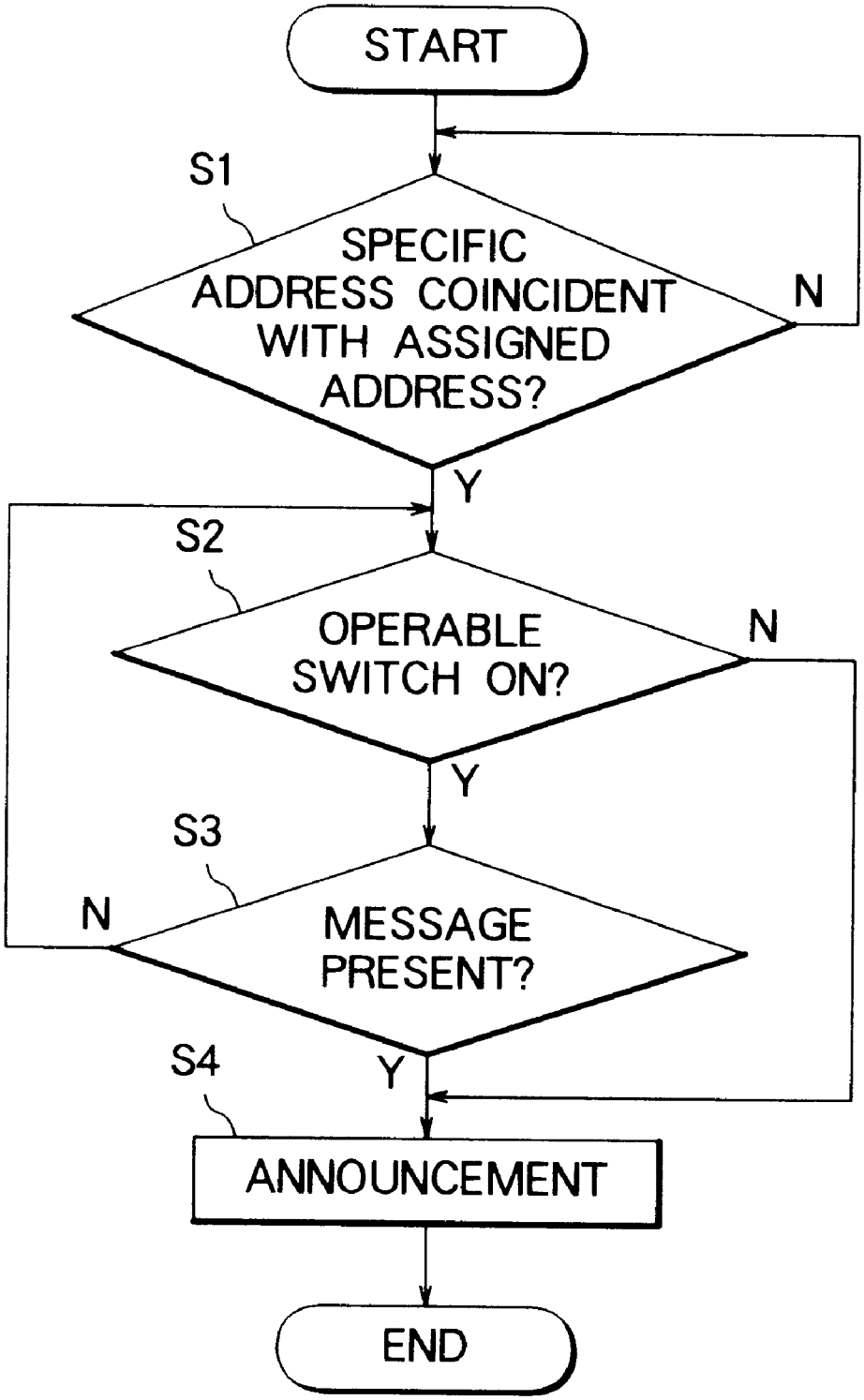
FIG. 2 is a flow chart for describing an operation of the radio paging receiver illustrated in FIG. 1.

Next referring to FIG. 2 in addition, the description will be made as regards an operation of the radio paging receiver.

When a call is present, a start is followed by a first step S1 at which the address collating section 15 judges whether or not the specific address is coincident with the assigned address. In other words, judgement is made in the address collating section 15 about whether or not the calling party has called the user of the radio paging receiver.

When the specific address is coincident with the assigned address, the first step S1 is followed by a second step S2 at which the mode control section 18 carries out judgement about whether or not the operable switch 16 is turned on by the user to have the on-state. When the operable switch 16 is set in the on-state, the mode control section 18 produces a particular mode signal. On carrying out the second step S2, the mode control section 18 will be referred to as a first judging arrangement.

When the operable switch 16 is set in the on-state, the second step S2 is followed by a third step S3 which will later be described. When the operable switch 16 is turned off to have the off-state, the second step S2 proceeds to a fourth step S4. At the fourth step S4, the mode control section 17 produces the first, the second, and the third control signals to make the loudspeaker drive, the LED drive, and the display control sections 19, 22, and 24 drive the loudspeaker 21, the LED 23, and the message display section 25, respectively. Consequently, the call is announced by the predetermined announcement irrespective of whether or not the message is present on the radio call signal received by the receiver. In this event, the mode control section 17 will be referred to as a first announcement-making arrangement which is making the announcing arrangement announce the announcement in response to the received signal with absence of the particular mode signal.

At the third step S3, the mode control section 17 carries out a judgement with reference to the form of the received signal about whether or not the waveform-converted signal carries the message. When the waveform-converted signal does not carry the message, the mode control section 17 produces a message absence signal. On carrying out the third step S3, the mode control section 17 will be referred to as a second judging arrangement.

When the waveform-converted signal does not carry the message, the third step S3 returns to the second step S2. This results in repeating the second and the third steps S2 and S3. Accordingly, upon reception of the radio call signal exclusively containing the specific address without the message, the call is not announced in a state where the operable switch 16 is turned on. On repeating the second and the third steps S2 and S3, the mode control section 17 will be referred to as an announcement inhibiting arrangement which is for inhibiting the operation of the announcing arrangement in response to the message absence signal.

When the waveform-converted signal carries the message, the third step S3 is followed by the fourth step S4 at which the call is announced by the predetermined announcement. In this event, the mode control section 17 will be referred to as a second announcement-making arrangement which is for making the announcing arrangement announce the announcement in response to the received signal with absence of the message absence signal.

Thus, in the radio paging receiver, upon reception of the radio call signal containing the specific address, the user of the radio paging receiver operates the operable switch 16 to select whether or not the predetermined announcement by audible indication and visible indication is to be carried out.

With the radio paging receiver, when the address alone is received without the message, the user can select announcement/non-announcement by his intention. Therefore, in case of transmission from the sender with the wrong address, the user of the radio paging receiver receiving it operates the announcement/non-announcement selecting means so that erroneous reception is not announced.

While the present invention has thus far been described in connection with a few embodiments thereof, it will readily be possible for those skilled in the art to put this invention into practice in various other manners. For example, the radio paging receiver may be designed so as to call the user only when it detects absence of the message. In this event, it is unnecessary that the radio paging receiver is provided with the displaying arrangement.

What is claimed is:

1. A radio paging receiver for being responsive to a radio call signal, comprising:

receiving means for receiving said radio call signal to produce a received signal;

announcing means for announcing announcement;

an operable switch, operable by a user while said radio paging receiver is energized and operating, for determining a particular mode concerning to an operation of said announcing means; and control means connected to said receiving means, said announcing means, and said operable switch for controlling said operation of the announcing means in accordance with a state of said operable switch and whether said received signal carries a message, wherein said control means comprises:

first judging means connected to said operable switch for judging about whether or not said operable switch determined said particular mode, said first judging means producing a particular mode signal when said operable switch determined said particular mode;

second judging means connected to said first judging and said receiving means for judging in response to said particular mode signal about whether or not a message is present in the received signal, said second judging means producing a message absence signal when said message is absent in said received signal; and announcement inhibiting means connected to said second judging and said announcing means for inhibiting said operation of the announcing means in response to said message absence signal.

2. A radio paging receiver as claimed in claim 1, wherein said control means further comprises:

first announcement-making means connected to said receiving and said first judging means for making said announcing means announce said announcement in response to said received signal with absence of said particular mode signal; and second announcement-making means connected to said receiving and said second judging means for making said announcing means announce said announcement in response to said received signal with absence of said message absence signal.

3. A radio paging receiver as claimed in claim 1, wherein said receiving means comprises:

a radio section supplied with said radio call signal for demodulating said radio call signal into a demodulated signal;

a waveform converting section connected to said radio section for converting a waveform of said demodulated signal into a converted waveform to produce a waveform-converted signal having said converted waveform;

an address memory for preliminarily memorizing an assigned address assigned to said radio paging receiver; and an address collating section connected to said waveform converting section, said address collating section, and said control means for collating said waveform-converted signal with said assigned address to produce said received signal only when said waveform-converted signal carries an address coincident with said assigned address.

4. A radio paging receiver as claimed in claim 1, wherein said announcing means comprises:

call indicating means connected to said control means for indicating a call as said announcement; and displaying means connected to said control means for displaying, as said announcement, a content which is represented by said received signal.

5. A radio paging receiver as claimed in claim 4, wherein said call indicating means comprises:

audible indicating means connected to said control means for audibly indicating said call; and visible indicating means connected to said control means for visibly indicating said call.

6. A method of being responsive to a radio call signal, said method comprising the steps of:

receiving said radio call signal to produce a received signal;

announcing an announcement of said received signal;

determining a particular mode concerning to said announcement, said determination being performed by a radio call receiver user;

judging about whether or not said particular mode is determined by the user;

producing a particular mode signal when said particular mode is determined;

judging in response to said particular mode signal about whether or not a message is present in said received signal;

producing a message absence signal when said message is absent in said received signal; and inhibiting said announcement in response to said message absence signal.

7. A method as claimed in claim 6, further comprising the steps of:

announcing said announcement in response to said received signal with absence of said particular mode signal; and announcing said announcement in response to said received signal with absence of said message absence signal.

8. A method as claimed in claim 6, wherein the receiving step comprises the steps of:

demodulating said radio call signal into a demodulated signal;

converting a waveform of said demodulated signal into a converted waveform to produce a waveform-converted signal having said converted waveform;

preliminarily memorizing an assigned address assigned to said radio paging receiver; and collating said waveform-converted signal with said specific address to produce said received signal only when said waveform-converted signal carries an address coincident with said specific address.

9. A method as claimed in claim 6, wherein the announcing step comprises the steps of:

indicating a call as said announcement; and displaying, as said announcement, said content that is represented by said received signal.

10. A method as claimed in claim 9, wherein the indicating step comprises the steps of:

audibly indicating said call; and visibly indicating said call.

* * * * *